US007608170B1

(12) United States Patent
Ousey

(10) Patent No.: US 7,608,170 B1
(45) Date of Patent: Oct. 27, 2009

(54) METHOD AND APPARATUS TO OBTAIN HIGH PRESSURES FOR A CONTINUOUS-FLOW PYROLYSIS REACTOR

(76) Inventor: John R. Ousey, 1414 Hunter La., West Chester, PA (US) 19380

( * ) Notice: Subject to any disclaimer, the term of this patent is extended or adjusted under 35 U.S.C. 154(b) by 449 days.

(21) Appl. No.: 11/355,794

(22) Filed: Feb. 16, 2006

Related U.S. Application Data

(60) Provisional application No. 60/689,233, filed on Jun. 10, 2005.

(51) Int. Cl.
*C10B 57/04* (2006.01)
*C10J 3/46* (2006.01)

(52) U.S. Cl. ..... 201/21; 201/41; 48/197 R; 48/200; 48/201; 166/302

(58) Field of Classification Search ..... 422/197, 422/109, 111, 207, 210; 210/752, 747; 166/302; 201/21, 41; 48/197 R, 200, 201
See application file for complete search history.

(56) References Cited

U.S. PATENT DOCUMENTS 3,606,999 A 9/1971 Lawless
4,416,956 A 11/1983 Lawless
4,792,408 A * 12/1988 Titmas ..... 210/747
4,803,054 A * 2/1989 Sillerud et al. ..... 422/109
4,937,052 A * 6/1990 Takahashi et al. ..... 422/242
5,008,085 A * 4/1991 Bain et al. ..... 422/109
7,211,194 B2 * 5/2007 Titmas ..... 210/752

* cited by examiner

*Primary Examiner*—N. Bhat
(74) *Attorney, Agent, or Firm*—Robert B. Famiglio; Famiglio & Associates

(57) ABSTRACT

The method enables the attainment of an open and continuous flow of an aqueous slurry containing carbonaceous solids into a high-pressure and high temperature environment which will result in the occurrence of at least two chemical processes: (1) aqueous pyrolysis (hydrous pyrolysis) and (2) hydrolytic disproportionation. This combination of processes will effect conversion of suspended organic materials into hydrocarbon liquids or gases depending on the mix of the temperature, pressure, and residence time in the reactor. Thereafter, the hydrocarbon-bearing slurry can be refined (separated into various constituents) using standard existing technologies.

19 Claims, 3 Drawing Sheets

METHOD AND APPARATUS TO OBTAIN HIGH PRESSURES FOR A CONTINUOUS-FLOW PYROLYSIS REACTOR

REFERENCE TO PRIOR APPLICATION

The Applicant claims the benefit of his U.S. provisional patent application Ser. No. 60/689,233 filed on Jun. 10, 2005.

BACKGROUND OF THE INVENTION

1. Field of the Invention

The present invention relates to an apparatus and method for obtaining high pressures in an open flow reactor which, coupled with elevated temperatures, provides an efficient and economic way to effect aqueous pyrolysis and hydrolytic disproportionation of carbonaceous materials into liquid or gaseous hydrocarbons suitable for use as fuels. The invention incorporates deep wells to utilize high hydrostatic pressures resulting from the weight of the material being processed.

2. Related Art and Background

Pyrolysis reactions with carbonaceous solids (strong heating in a low-oxygen or oxygen-free environment) has a long history with numerous 'town gas' plants using the process to convert coal into gases that were then delivered via pipelines to customers in communities all over the country. These facilities were phased out within a decade of World War II as natural gas became widely available. Underground conversion of coal to gas or liquids is presently the subject of experimentation. Most of such experimentation involve some form of boring wells into a coal seam and initiating combustion at one. An oxidant such as air is introduced into the well and the gaseous pyrolysis products are removed at the other well. At the surface the gases can be used directly as fuel to generate electricity, or converted into a liquid such as methanol. Hydrocarbon liquids are produced only in small amounts with this technique.

Aqueous pyrolysis is an alternate method of direct recovery of energy recovery from coal. High temperature steam is introduced and a reaction results in the conversion of some coal into high-quality liquid hydrocarbons. Large amounts of energy are needed to provide the quantity and temperature of steam required to drive this reaction forward in the coal seam.

In another form, coal slurry is introduced into high pressure, high temperature reactors at the surface and yields a significant amount of liquid and gaseous hydrocarbons. In either case there exists a need for a technique to produce liquid and gaseous hydrocarbons from solid carbonaceous materials that is efficient in the percent conversion of raw material and sparing of the energy used in the conversion process. The in-situ (subsurface) processes appear to lose a significant fraction of the gross energy in the source materials and surface-based technologies are quite capital intensive, requiring a large and complex facility to generate the desired output of fuel hydrocarbons.

While aqueous pyrolysis is a chemical process that has been extant for several decades and thus is fairly well-known, hydrolytic disproportionation has only recently been recognized as a process of fundamental importance in the field of organic geochemistry which, among other things, deals with the formation of petroleum and natural gas from organic precursors in the rocks and sediments. For example, a 1991 paper in the publication Science by Siskin and Katritzky addressed the reactivity of organic compounds in heated water. This earlier work included the teaching that, in natural systems where kerogens are depolymerized, hot water is ubiquitous and usually contains salt and minerals. Reactions such as ionic condensation, cleavage, and hydrolysis are facilitated by changes in the chemical and physical properties of water as temperature increases. It was presented that such changes make the solvent properties of water at high temperature similar to those of polar organic solvents at room temperature, thus facilitating reactions with organic compounds.

No conclusions of the earlier investigators presented an application for the theories advanced, though it was suggested that an understanding of aqueous organic chemistry may lead to potential applications in areas as diverse as the recycling of plastics, the synthesis of chemicals, and coal liquefaction. The concept of hydrolytic disproportionation is a more recent concept that comes from literature dealing with the production and accumulation of oil and gas in sediments and sedimentary rock.

In 2001, L. C. Price prepared a chapter for a U.S. Geological Survey publication: Geologic Studies of Deep Natural Gas Resources. Price dealt with the generation of natural gas from deposits of "spent kerogen"—deposits that were supposedly done with the generation of hydrocarbons, but were still producing it anyway. The data from this early investigator supported a previous suggestion that water and high-rank, deeply buried, post-mature kerogen possibly undergo hydrolytic-disproportionation reactions with one another, resulting in the generation of high-rank methane-rich gas.

The Price reference taught that the term "hydrolytic disproportionation" of organic matter results from the premise that the water disproportionates into charged ions which then react with organic matter, which also disproportionates, to form an oxidized carbon species and a lower-molecular weight hydrocarbon, compared to the molecular weight of the starting organic matter.

Another important background article entitled "Organic-inorganic interactions in petroleum-producing sedimentary basins" was published in Nature (2003) by J. S Seewald. The target of this reference is not coal liquefaction specifically, but the chemistry and hydrolytic disproportionation processes discussed are germane to the technology of the present invention.

Such earlier investigations and background art approach the issue of HCC from the standpoint of oil or natural gas reservoirs, not the deliberate conversion of solid hydrocarbons into liquids and gases. The conclusion to be drawn from the above publications as well as many others in the art is that there exists a need for a means to economically apply high temperature and pressure water (perhaps as high as supercritical conditions) capable of reacting with complex carbon compounds to produce both liquid and gas-phase hydrocarbons.

At the same time it would be advantageous to develop a technique to produce liquid and gaseous hydrocarbons from solid carbonaceous materials that is sparing of the energy used in the conversion process. The in-situ (subsurface) processes of any present technology appear to lose a significant fraction of the gross energy in the source materials. Surface-based technologies are quite capital intensive, requiring a large and complex facility to get the desired output of fuel hydrocarbons.

It appears that the greatest obstacle to commercialization of such processes is, in large part, the high cost of installing and operating the high pressure/temperature reactors to bring about the conditions necessary to achieve aqueous pyrolysis and hydrolytic disproportionation. This problem coupled with the limited throughput of reactors operating in more or less 'batch mode' means a low overall yield for high costs of operation. Thus the key to a successful HCC process using these principles lies in development of a reactor that can sustain high temperatures and pressures together with a high-rate continuous throughput of raw material being subjected to the conditions that will convert the solid HC to liquid and gas fuels.

In the past, inventors have also realized that the hydrostatic pressure available at deep depths such as existing water or petroleum wells may be sufficient to produce pressures which far exceed what can be obtained in conventional apparatus using only mechanical pumping equipment to obtain such pressures. However, it has not been appreciated in the past that such pressures obtainable in deep boreholes may be used to improve the processing identified in the present disclosure. For example, U.S. Pat. Nos. 3,606,999 issued in 1971 and 4,416,956 issued in 1983, both to Lawless, describe apparatus for carrying out a chemical or physical process, identifies the usefulness of a deep borehole, but applies such usefulness only for fuel cells to use a chemical reaction for producing electricity. Lawless identifies the usefulness of deep boreholes for certain processes but fails to realize or teach the application or possible use to perfect hydraulic disproportionation of a coal slurry or similar material into liquid or gaseous hydrocarbons. Further, any prior art does not teach introduction of energy into the system to process slurry at the point in which it flows into the reactor zone.

SUMMARY OF THE INVENTION

The present invention discloses both apparatus and a process to bring about the conversion of solid carbonaceous material, in aqueous slurry, into liquid and/or gaseous hydrocarbons that can be separated from the water and each other using standard refining techniques. The invention utilizes existing deep well facilities to provide an economically viable means to obtain very high pressures necessary to process the aqueous slurry. The material being processed provides the processing pressure required through its own weight. The mass of the slurry, measured at the bottom of the long vertical column, created by a deep well, creates pressures therein which allow the processing to occur. The invention avoids the need to generate such high pressures necessary using vessels or compression techniques which would otherwise be required to process the slurry at ground level. The invention provides two different novel approaches to adding energy to the system to cause or enhance the reaction in a reaction zone. The reaction zone is generally located at a depth within a bore hole or deep well sufficient to reach super critical conditions, being temperatures of about at least 374 degrees Celsius and pressures of about at least 220 atmospheres.

In a first embodiment, a tube-style electrical resistance heater constructed of heat and corrosion resistant stainless steel is emplaced at the base of the second concentric pipe and partially emergent from it, into the reactor zone. The innermost pipe contain the electrical conductors that lead to the control box at the surface. Tube-type immersion resistance heaters are commercially available in a variety of diameters and lengths, and some manufacturers indicate their ability to custom make heaters to specified sizes. The advantage of using an electric resistance heater in this embodiment is the ability to carefully and precisely control the amount of energy being introduced into the reactor zone.

While the aqueous pyrolysis reactions are endothermic and thus are driven by the heat applied, the hydrolytic disproportionation reactions involve interactions with the dissociated hydrogen and oxygen atoms of the water molecule and are likely to be exothermic. Just how much heat is given off will be controlled by a variety of factors such as the type and concentration of organic matter in the slurry, the redox-potential of the water, the residence time in the reactor zone, and possible catalytic properties of non-carbonaceous materials (e.g. minerals or solutes) that are inadvertently or perhaps deliberately introduced into the reaction zone via the slurry.

In a second embodiment, adding heat to the slurry as it enters the reactor zone may be accomplished by the introduction of a strong oxidizer (e.g., 30% hydrogen peroxide) by means of an innermost pipe placed coaxially within a conduit or pipe which conveys the slurry into the reactor zone, releasing it into the slurry just as it exits a second pipe (in which the oxidizer pipe is located) into the reactor zone. The oxidizer will react with some of the carbonaceous matter and increase the slurry temperature yielding supercritical conditions in the reactor zone. As discussed above in the case of electrical resistance heating it may or may not be necessary to continue the flow of the oxidizer to the reactor zone depending on whether a self-sustaining reaction can be attained via the exothermic reactions of hydrolytic disproportionation. The innermost pipe used to provide oxidizers can also be use to introduce catalysts into the system should that be necessary or useful.

In a preferred embodiment a long steel or stainless steel pipe, about Ten Thousand (10,000) feet in length (about 3000 meters), is inserted vertically into the ground using standard well-drilling techniques. The pipe is welded shut at the bottom or sealed using high temperature concrete. A second, smaller pipe is centered inside of the primary pipe and will reach to within a few meters of the base of the outer pipe. A third and smaller pipe will be likewise centered in the second pipe resulting in three concentric pipes.

The 3000 meter depth of the outer pipe, when filled with water (or coal slurry) will be at a pressure of approximately 220 atm (atmospheres), just above the pressure needed for supercritical conditions in water. While 2,200 meters (7,200 feet) would be sufficient to attain 220 atmospheres of pressure at temperatures well below 374° C., as the temperature approaches supercritical conditions the water density is reduced. The difference in length between 3,000 meters and 2,200 meters is to accommodate this reduction in density. The pressure outside of the pipe will be at the same pressure that is caused by the depth of the pipe within the earth. Thus the pipe only has to be strong enough to resist reaction overpressures, not the entire 220 atm. The second pipe will convey slurry comprised of water and powdered coal fines (or other carbonaceous solids) that has been heated at the surface and pumped in. The innermost pipe will convey an oxidizer such as hydrogen peroxide to the reactor zone near the bottom of the pipe. The oxidizer will react with some of the coal to increase the slurry temperature to the 374° C. point yielding supercritical conditions in the reactor zone.

The prior art does not suggest an answer, but it may be that the hydrolytic disproportionation reactions are sufficiently exothermic to be self sustaining once the aqueous pyrolysis has begun. If this is not the case for a given system reaction, it will be necessary to continue the flow of the oxidizer to, or heating by the electrical resistance heater in the reactor zone. The reaction can be monitored in real time to adjust system requirements as the case may be. The innermost pipe can also be use to introduce catalysts into the system should that be necessary or useful.

As the carbonaceous slurry is pumped down the inner pipe, the displaced reactant products will rise in the outer pipe to the surface where separation of the various components can be effected. This should include produced hydrocarbons, water (perhaps as steam), and a sludge consisting of mineral matter and unreacted carbonaceous material. Since the product will be quite hot as it come to the surface, some refining of the hydrocarbons can be accomplished at the surface site of the reactor using standard technology. There may be enough steam and other hot gases to drive a turbine to generate electricity. The waste sludge may be separated and recycled if there is sufficient organic material to warrant or, depending on the physical properties of the sludge, used as an asphalt aggregate binder, or sent to waste (e.g. into the mines providing the carbonaceous matter). The time the carbonaceous slurry spends in the critical zone of the reactor can be controlled by the flow rate or the length of the pipe that lies below the depth required to attain supercritical conditions.

It is therefore the object of the present invention to describe and provide both a method of processing and an apparatus to use therewith which utilizes existing hydrostatic pressures within deep boreholes or wells by use of the mass of the liquid or fluidized solids which are to be processed through a continuous system.

It is another object of the present invention to provide an apparatus for processing organic materials in the form of aqueous slurry such as various forms of coal and kerogen rock, and waste materials such as plastics, by applying high pressures inherently generated by the weight of the material being processed within existing deep wells to allow for such processing without the need to add large amounts of energy to the system for such processing.

It is another object of the present invention to provide apparatus and means to process coal slurry at atmospheric pressures and/or temperatures approaching or exceeding super critical conditions, i.e. 220 atmospheres of pressure and/or 374 degrees Celsius, without the need to create complex mechanical vessels to create such pressures at or above sea level.

It is yet another object of the present invention to provide a novel solution to the generation of high pressures without the need to create such pressures mechanically through pressure generation means by allowing material to be processed to create its own pressures through the hydrostatic pressures created by a large vertical column of such materials being acted upon by gravity.

DETAILED DESCRIPTION OF THE INVENTION

Figure 1:
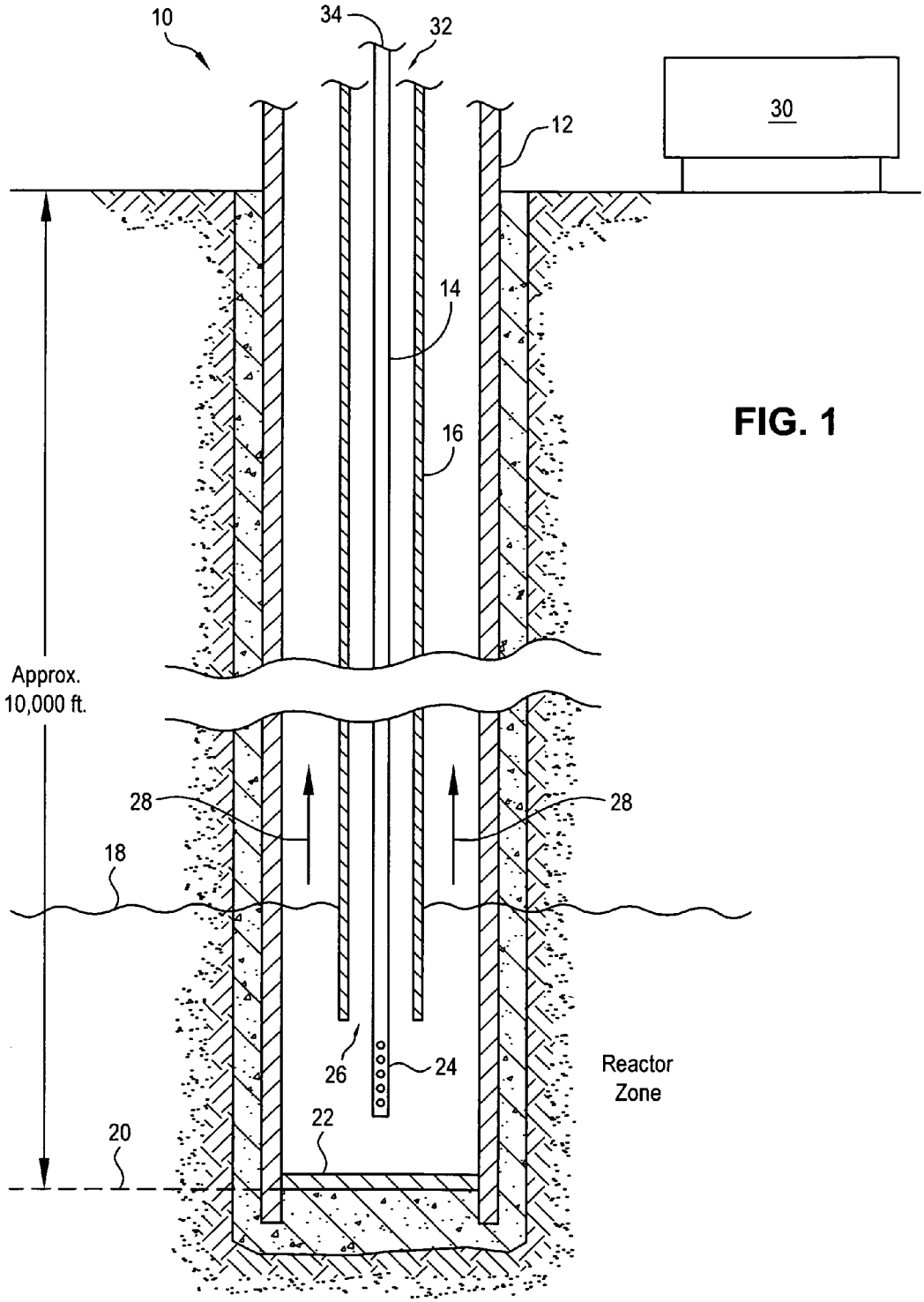
FIG. 1 is a pictorial diagram disclosing an example of a simple embodiment of the invention illustrating a cut-a-way view of a typical installation of the process disclosed.
Figure 2:
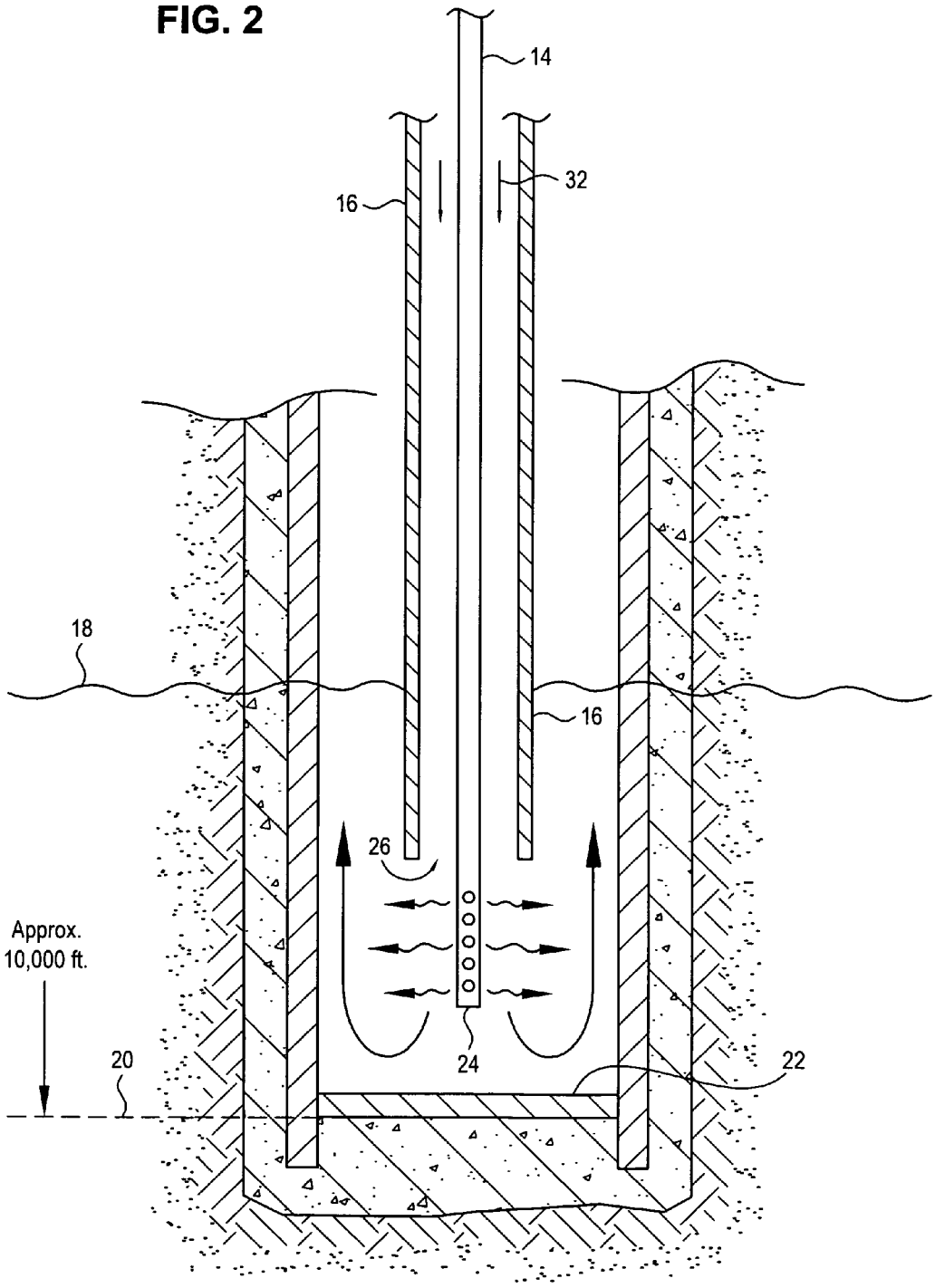
FIG. 2 is a pictorial diagram of the reaction zone of the present invention illustrating a typical flow of material to be processed and the reaction of the material being processed.

And now an embodiment the invention will be described in more detail with particular reference to the drawing wherein like-numerals refer to like-parts. This description is only an example of a possible application of the apparatus and method of the preferred embodiment. The entire reactor 10 is depicted in pictorial form by way of example in FIG. 1. Well casing 12 is inserted in the earth using such means as may be appropriate for the type of drilling required and subsequently sealed at the bottom. The technology for drilling deep wells and sealing the well casing are known to those skilled in the art, as such are used in other types of geological exploration such as oil or coal exploration or other types of deep earth exploration. Outer pipe 16 is placed within well casing 12 as shown. Inner pipe 14 is spaced coaxially within the outer pipe 16, both pipe 14 and 16 being continuous from the entry of the shaft to what is generally referred to as the reactor zone in FIG. 1.

As described above, it is necessary that well casing 12 extend to such areas within the earth to allow the required pressures to produce a reaction. Reaction depth 18 is approximately 10,000 feet, so that well casing bottom 22 must extend at least to that point and sufficiently beyond such point to depth 20 as suggested in FIG. 1. The depth between reaction depth 18 and depth 20 comprises a zone in which the process desired and as described above would occur to process aqueous slurry containing the carbonaceous solids. The difference between the reaction depth 18 and bottom depth 20 could be only several meters. The desired high pressure environment exists between depth 18 and depth 20.

An aqueous slurry of the solids desired to be processed is introduced into the system through pipe 16 at point 32. The process would be supported in continuous fashion by the insertion of slurry and the removal of processed slurry, all to be supported by apparatus in a process building 30 as suggested in FIG. 1. For clarity, the process connections for reactor 10 are not shown in FIG. 1 to reduce clutter. However, conventional pumping, pressurization, control monitoring and other such processes which could be applied to use the invention would be contained nearby in process building 30 and connected in a conventional fashion. Supplies of material to be processed would be stored within such infrastructures as are known to those skilled in continuous processes such as presented in the example.

When outer pipe 16 is filled with coal or another aqueous slurry, or even with water, it will be appreciated that the pressure at the bottom of the 10,000 foot depth would be approximately 220 atmospheres of pressure. The well bottom 22 is an integral part of the well casing 12 such that pressure is contained within the vessel. The vessel walls are supported by the earth surrounding casing 12 thereby supporting well casing wall 12 in such a high pressure environment. Casing 12 need only withstand and support the additional pressures created by the materials being processed in that the weight of the earth surrounding the casing is presenting an equal pressure upon the well casing 12.

Slurry to be processed is sent down pipe 32, thereby presenting material to slurry output 26 at the bottom of casing 12. The pressure of the slurry above input 26 creates the pressure to process material in the reactor zone.

Inner pipe 14 can be used to present an oxidizer as suggested, i.e. hydrogen peroxide or some other oxidizer to the reactor zone near the bottom of the pipe. A suitable oxidizer is introduced into oxidizer input 32. The oxidizer exits into the reactor zone at point 24 shown in FIG. 1. As the pressure and the oxidation processes coal slurry or other solid carbonaceous material, the continuous presentation of slurry through pipe 16 causes displacement of the processed slurry and the migration of the processed slurry up the well casing 12 as processed output 28. It will be appreciated that as a continuous process, processed output 28 will be conveyed to the top of well shaft 12 as additional slurry material is introduced into the system at slurry input 32 under pressure sufficient to cause displacement and output of the processed material.

The depth of the reactor zone or the difference between depth 18 and 20 can be adjusted as needed depending on the throughput of material desired and the amount of time necessary to obtain the conversion of the material desired. Throughput can be controlled both through the introduction rate of slurry at 32, the introduction rate of oxidizer at 34, and the ultimate depth of the well casing bottom depth 20.

Figure 3:
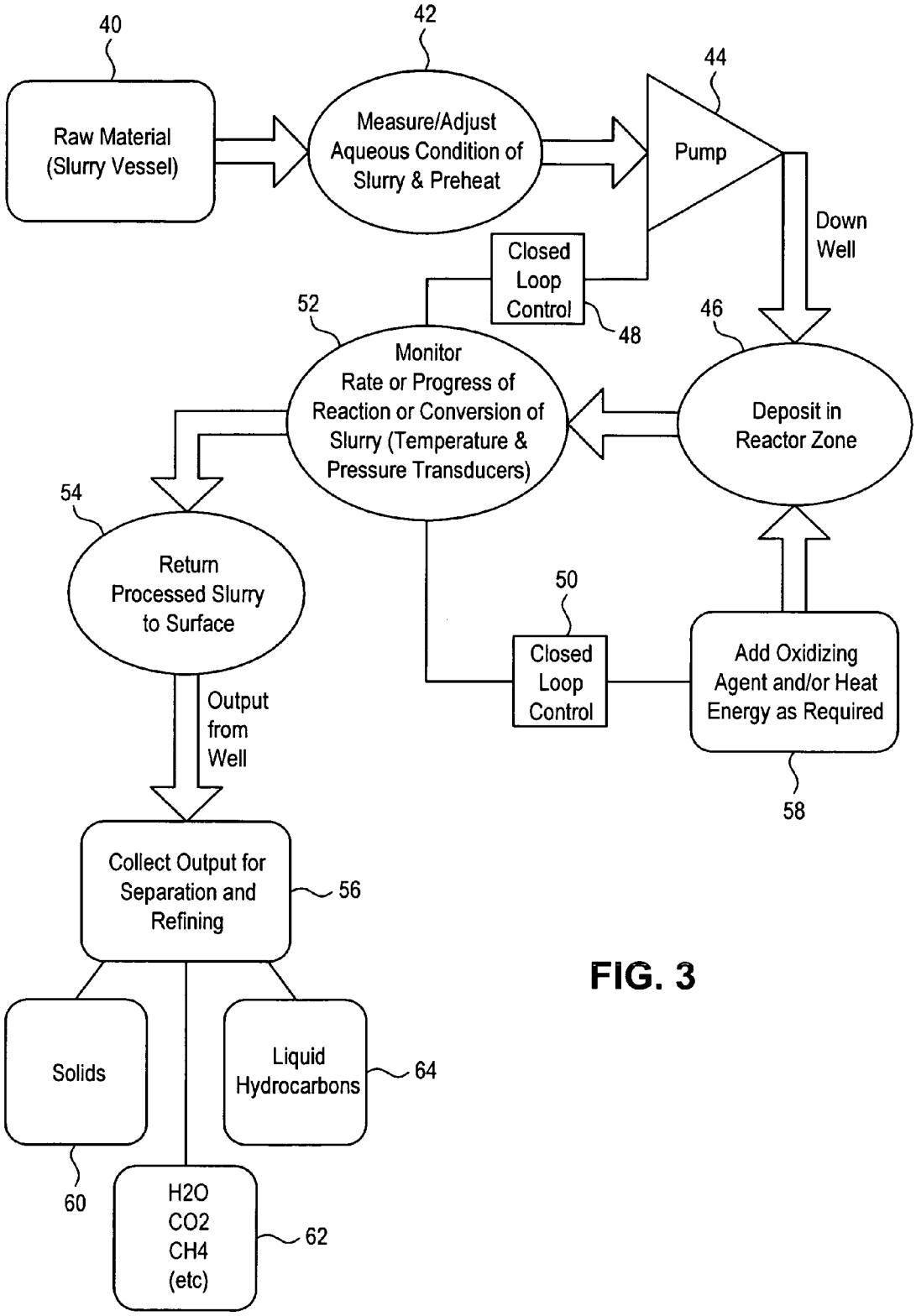
FIG. 3 is a block diagram of a simple mechanical system which may be applied in the preferred embodiment to provide a continuous throughput processing system for coal slurry, including an oxidizer means.

FIG. 3 is a block diagram disclosing useful steps employed in the present invention. Raw material is collected in the slurry vessel 40 and is processed by measuring or adjusting the aqueous condition of the slurry at 42 as may be desirable for a particular application. The slurry to be processed is then introduced into pressure means such as pump 44 to convey the material into the deep well, delivering it into reactor zone 46. It can be appreciated that pump 44 must be a sufficient system to provide continuous flow of the slurry, such that it may displace processed slurry from the reactor zone and allow for a continuance conveyance of the material. In a variation of the invention it can be appreciated that it is desirable to monitor the rate or progress of reaction of the slurry to be converted at 52. By monitoring such progress a control loop 48 can adjust the pressure being applied by pump 44, thereby controlling the rate of processing. If additional time in the reaction zone is required to obtain useful processing of a given slurry, pump 44 would reduce the throughput in that regard allowing the material to linger in the reaction zone longer.

Since a variation of the preferred embodiment includes adding an oxidizing agent to speed up or to increase the reaction which occurs in the reactor zone, the oxidizing agent can likewise be part of a close loop control at 50, which increases or decreases the given oxidizing agent depending on the rate or progress of reaction 52. Conventional industrial control system methods can be used to increase the efficiency or to otherwise adjust the rate of flow of material for a given slurry and for the type or amount of oxidizing agent which might be applied to increase temperatures or enhance process time within the reaction zone. Likewise, the step of adding an oxidizing agent and/or heat energy through electric heating elements or other types of heat systems can be controlled by a closed loop control 50. Monitoring the temperature and pressure, as well as other environmental parameters in reactor zone 46 can be used both to control the rate of pump 44 and the addition of an oxidizing agent or other type of energy source as may be desired given the throughput of the processing. Closed loop control 50 provides feedback information from the monitoring conditions at 52 so that either pump 44 is adjusted through closed loop control 48 or the oxidizing agent, or other energy is added or reduced in the system through closed loop control 50. It will be appreciated by those skilled in industrial processing systems and closed loop control apparatus that the invention can be controlled and automated by utilizing feedback information through field observed parameters that are adjusted in the control set points and systems which allow adjustment of major system parameters to obtain the steady state conditions that may be desired given processing parameters actually monitored in the field.

Processed slurry is then returned to the surface at 54, being discharged from the well. Processed slurry is then collected at output 56 for further processing or use. The output from the system disclosed will be comprised of solids 60, volatile gases such as water vapor, carbon dioxide and other hydrocarbons 62, and liquid hydrocarbons 64. Separation of these components at the surface may be accomplished through a variety of different systems which are available and will likely be known to those skilled in the art of such collection, separation and refining processes.

Although the invention has been described in accordance with the preferred embodiment, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention.

What is claimed is:

1. A method to obtain supercritical conditions for a continuous flow aqueous or hydrous pyrolysis reaction comprised of the steps of collecting an aqueous slurry of carbonaceous solids;

conveying said carbonaceous solids to a depth within an existing opening in the earth to create hydrostatic pressure sufficient to present supercritical conditions from the weight of said slurry;

defining a reaction zone in the vicinity of the deepest portion of said earth opening where said supercritical conditions are generated; and providing for a continuous throughput of said slurry, such that after the slurry is conveyed to said reactor zone, and thereafter transported back to the surface location.

2. A method to process an aqueous slurry comprised of the steps of:

collection of raw material to be processed as a slurry;

adjust the aqueous condition of the slurry as may be required for a desired result;

pumping the slurry down a deep well into a reactor zone sufficiently deep to obtain hydrostatic pressures sufficient to present supercritical conditions to cause processing of said slurry;

monitor the rate of progress of reaction of the processed slurry in the reaction zone;

returning the processed slurry to the surface; and collecting the processed slurry for use.

3. The method in claim 2 further comprised of adjusting the rate of pumping of the slurry material based on the rate of conversion of the slurry in the reaction zone.

4. The method of claim 3 further comprising the step of adding an oxidizing agent to the reaction zone.

5. The method of claim 4 above, whereas the step of adding an oxidizing agent further includes adjusting the amount of said agent in proportion to the said monitored progress of reaction of the slurry.

6. The method of claim 3 further comprising the step of adding heat energy to the reaction zone.

7. A method of processing an aqueous slurry of material at an elevated pressure and temperature which comprises:

presenting said aqueous slurry within a pressure zone which is pressurized by a depth of said slurry sufficient to produce an elevated pressure sufficient to produce supercritical conditions with said slurry, said pressure zone being within a generally vertical, laterally confined space;

separately introducing energy to said pressure zone to initiate a reaction of the aqueous slurry;

conveying said slurry between said pressure zone an the upper end of said confined space through a conduit extending downwardly in said space to said pressure zone; and withdrawing the resultant of said reaction from said pressure zone.

8. A method as defined in claim 7, wherein said aqueous slurry includes carbonaceous solids.

9. A method as defined in claim 7 wherein said energy introduced is an oxidizing agent.

10. A method as defined in claim 7, wherein said oxidizing agent flows downwardly separately from said conduit conveying said slurry.

11. A method as defined in claim 7, wherein said pressure zone is defined by a depth which creates at least supercritical conditions in the said slurry.

12. A method as defined in claim 7 wherein said energy introduced results from electrical energy.

13. A method as defined in claim 7, wherein said pressure zone is defined by a depth of about 10,000 feet.

14. An apparatus for the continuing processing of carbonaceous solid slurry comprised of:

an outer vessel emplaced within the earth to a depth necessary to obtain hydrostatic pressure sufficient to present supercritical conditions from the weight of the slurry;

a means to convey said slurry to be processed to said designed depth within said outer vessel for processing; and a means to convey the said slurry after processing within said reactor zone back to the surface.

15. An apparatus to obtain high pressures for the processing of a carbonaceous-solid slurry comprised of:

a sealed first vessel emplaced to a depth within the earth to obtain a hydrostatic pressure sufficient to create supercritical conditions resulting from the weight of the carbonaceous-solid slurry;

a second vessel disposed within said first pipe, and open at the bottom of said pipe, extending from the surface to substantially the lowest portion of said outer vessel;

means to transport said slurry to be processed through said second vessel into the substantially lowest portion of said first vessel; and means to return said slurry through said first vessel back to the surface after said slurry is processed.

16. Apparatus for carrying out a chemical process at an elevated pressure and involving an aqueous slurry including carbonaceous solids, comprising:

means defining a vertically elongated, laterally enclosed space, said space including a reaction zone at the lower portion of said vertically elongated space;

means for introducing said aqueous slurry adjacent the top of said space means, so that the desired pressure is produced by the hydrostatic head of said aqueous slurry in said reaction zone of said space;

a pipe extending downwardly within said space to said reaction zone for introducing an oxidizing agent to said reaction zone;

means for collecting resultants of the reaction within said reaction zone; and means for conveying said resultants from the said reaction zone to the top of the said vertically elongated space.

17. Apparatus as defined in claim 16 wherein said means defining said space comprises:

a bore extending downwardly into the earth a sufficient distance to provide for the creation of supercritical conditions to be present within said aqueous slurry; and a pressure vessel within said bore.

18. Apparatus as defined in claim 16, wherein said downwardly extending pipe conveys said slurry to the lower portion of said pressure zone.

19. Apparatus as defined in claim 16, further including an upwardly extending pipe conveys the reaction product of said slurry upwardly, said slurry moving separately from the said slurry introduced at the top of the said vertically elongated space.

* * * * *